US006118410A

United States Patent [19]

Nagy

[11] Patent Number: 6,118,410

[45] Date of Patent: Sep. 12, 2000

[54] AUTOMOBILE ROOF ANTENNA SHELF

[75] Inventor: Louis Leonard Nagy, Warren, Mich.

[73] Assignees: General Motors Corporation, Detroit; Delphi Technologies, Inc., Troy, both of Mich.

[21] Appl. No.: 09/354,756

[22] Filed: Jul. 29, 1999

[51] Int. Cl.[7] ..... H01Q 1/32

[52] U.S. Cl. ..... 343/713; 343/711; 343/712; 343/700 MS

[58] Field of Search ..... 343/713, 711, 343/712, 700 MS

[56] References Cited

U.S. PATENT DOCUMENTS

| | | | |
|---|---|---|---|
| 5,528,314 | 6/1996 | Nagy et al. | 348/713 |
| 5,739,794 | 4/1998 | Nagy et al. | 343/713 |
| 5,867,129 | 2/1999 | Sauer | 343/713 |
| 5,973,648 | 10/1999 | Lindenmeier et al. | 343/713 |
| 6,008,766 | 12/1999 | Maeda et al. | 343/713 |
| 6,020,855 | 2/2000 | Nagy et al. | 343/713 |
| 6,025,806 | 2/2000 | Deininger et al. | 343/713 |
| 6,028,557 | 2/2000 | Oka | 343/713 |

OTHER PUBLICATIONS

"Planar Cellular Antenna for Automobile Window Mounting," Research Disclosure No. 346127, Feb. 1993.

*Primary Examiner*—Don Wong
*Assistant Examiner*—Ephrem Alemu
*Attorney, Agent, or Firm*—George A. Grove

[57] ABSTRACT

An automobile roof antenna shelf positioned below a vehicle window, such as a vehicle windshield or vehicle rear window, that provides a mounting structure for mounting a plurality of high frequency antennas. The vehicle window includes an extended portion that extends into the vehicle roof over the shelf, and defines a gap therebetween. The plurality of antenna are mounted on the shelf within the gap.

18 Claims, 2 Drawing Sheets

AUTOMOBILE ROOF ANTENNA SHELF

TECHNICAL FIELD

This invention relates generally to an antenna mounting shelf on a vehicle and, more particularly, to a vehicle roof antenna shelf on which is mounted a plurality of high frequency antennas, where the shelf is covered by an extended portion of a vehicle windshield.

BACKGROUND OF THE INVENTION

Most modern vehicles include a vehicle radio that requires an antenna system to receive amplitude modulation (AM) and frequency modulation (FM) broadcasts from various radio stations. Many vehicle antenna systems include a mast antenna that extends from a vehicle fender, vehicle roof, or some applicable location on the vehicle to receive these broadcasts. Improvements in vehicle antenna systems have included the development of backlite antenna systems, where antenna elements are formed on a rear window of the vehicle. The antenna elements in the backlite antenna systems are typically made of a conductive frit deposited on an inside surface of the window. Additionally, vehicle windshield antennas, such as the solar-ray antenna disclosed in U.S. Pat. No. 5,528,314, have also been developed. The solar-ray antenna includes a transparent conductive film laminated between the inner and outer glass sheets of the windshield. The windshield and backlite antenna systems provide a number of advantages over mast antenna systems, including no wind noise, reduced drag on the vehicle, elimination of corrosion of the antenna, no performance change with time, limited risk of vandalism, and reduced cost and installation.

Advancements in vehicle communications technology has led to the need for various high frequency antenna systems to provide reception for different communication systems, such as radio frequency accessories (RFA), including keyless entry systems, cellular telephone, global positioning system (GPS), personal communication system (PCS), etc. Because these antenna systems operate at higher frequencies than the AM and FM frequency bands, the size of the antenna is reduced from AM and FM antenna systems. These high frequency antennas must be positioned on a vehicle at a location where the antenna radiation does not interfere with the conductive vehicle body. It has been suggested to incorporate high frequency antennas in the vehicle windshield or backlite in combination with the existing AM/FM antennas to provide an "antenna farm." See Research Disclosure No. 346,127, published 1993. In this design, the high frequency antennas are mounted on an inside surface of the inside glass sheet of the windshield along a top edge of the windshield so that they do not obstruct the view of the vehicle operator.

The antenna farm concept as it currently exists suffers from a number of drawbacks. For example, the available space on existing vehicle windshields for providing antennas is limited, and the number of antennas that may ultimately be required may exceed this available space. Additionally, it may be detrimental from an antenna performance standpoint to allow radiation from the antenna to enter the passenger compartment of the vehicle. Other disadvantages also come into play for providing so many high frequency antennas on the existing vehicle windshields.

What is needed is a structure that enables mounting of a plurality of high frequency antennas on a vehicle windshield or backlite glass that does not suffer from certain disadvantages, such as those mentioned above. It is therefore an object of the present invention to provide such a structure.

SUMMARY OF THE INVENTION

In accordance with the teachings of the present invention, a combination of a vehicle window and an antenna mounting structure is disclosed that allows a plurality of high frequency antennas to be mounted on the structure below the window. In one embodiment, a top portion of a vehicle windshield is extended so that it extends over the present windshield roof line in a curved contour. A roof ledge of the vehicle roof panel extends below the curved top portion of the windshield and is separated therefrom by a predetermined distance to allow the antennas to be mounted on the ledge. The ledge acts as a conductive ground plane for the various antenna and prevents antenna radiation from entering the vehicle compartment.

Additional objects, advantages and features of the present invention will become apparent from the following description and appended claims, taken in conjunction with the accompanying drawings.

DESCRIPTION OF THE PREFERRED EMBODIMENT

The following discussion of the preferred embodiments directed to an extended vehicle windshield and antenna shelf combination is merely exemplary in nature and is in no way intended to limit the invention or its applications or uses. The discussion below is directed to a vehicle windshield and combination specialized antenna shelf. However, other vehicle windows, including vehicle backlites, can also be extended in association with the vehicle roof in the same manner as described below.

Figure 1:
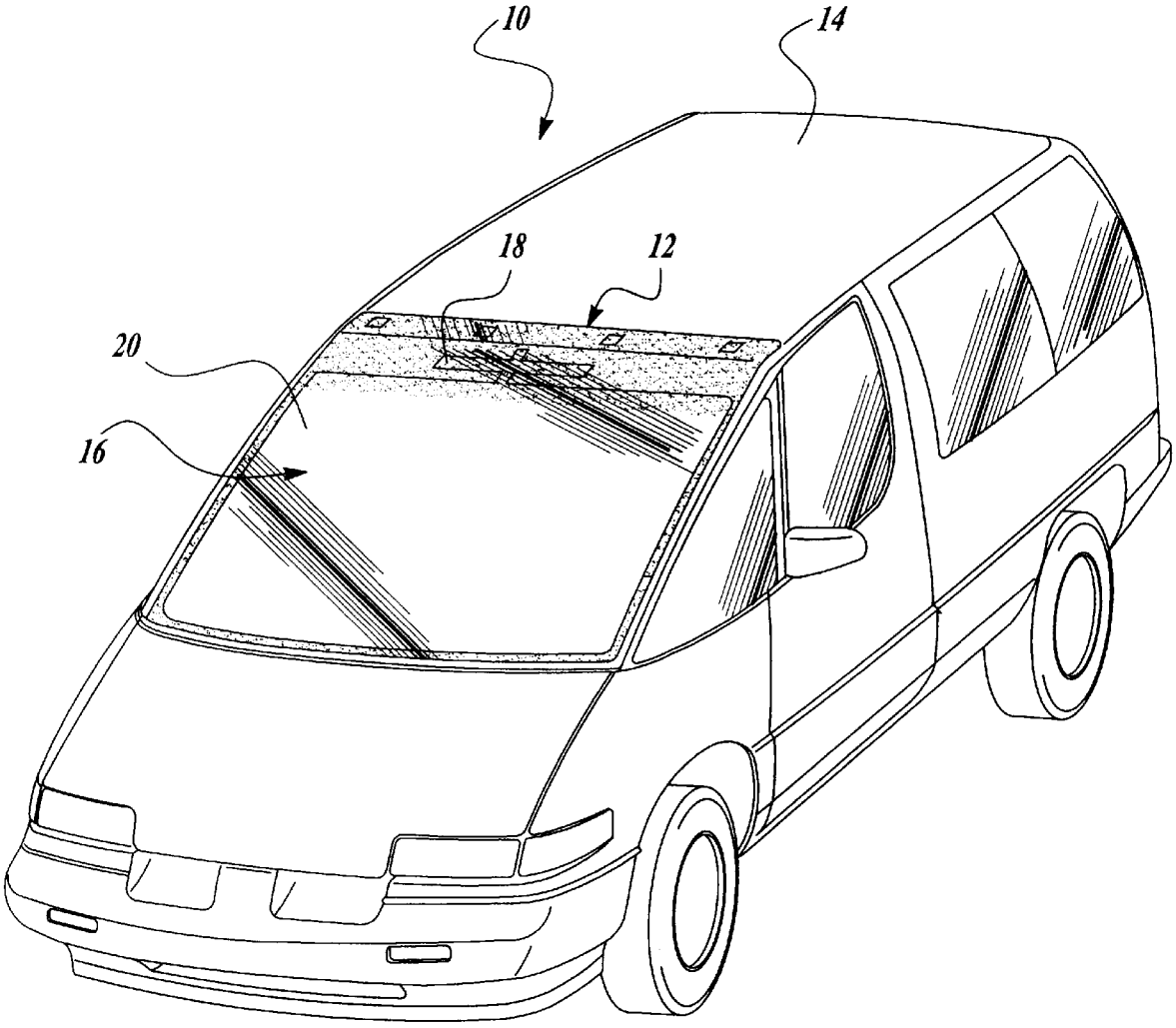
FIG. 1 is a perspective view of a vehicle including an extended windshield in association with a plurality of high frequency antennas, according to an embodiment of the present invention.

FIG. 1 is a perspective view of a vehicle 10 including a vehicle windshield 12 and a vehicle roof panel 14. The vehicle windshield 12 includes a solar-ray antenna 16 for providing AM and FM reception of the type disclosed in the '314 patent referred to above. The solar-ray antenna 16 includes a conductive film configured as shown to include a tuning element 18 and an impedance element 20, where the tuning element 18 runs along a top edge of the windshield 12. The conductive film is formed on an inside surface of an outer glass layer 22 so that it is positioned between the outer glass layer 22 and an inner glass layer 24 (see FIG. 3) of the windshield 12.

Figure 2:
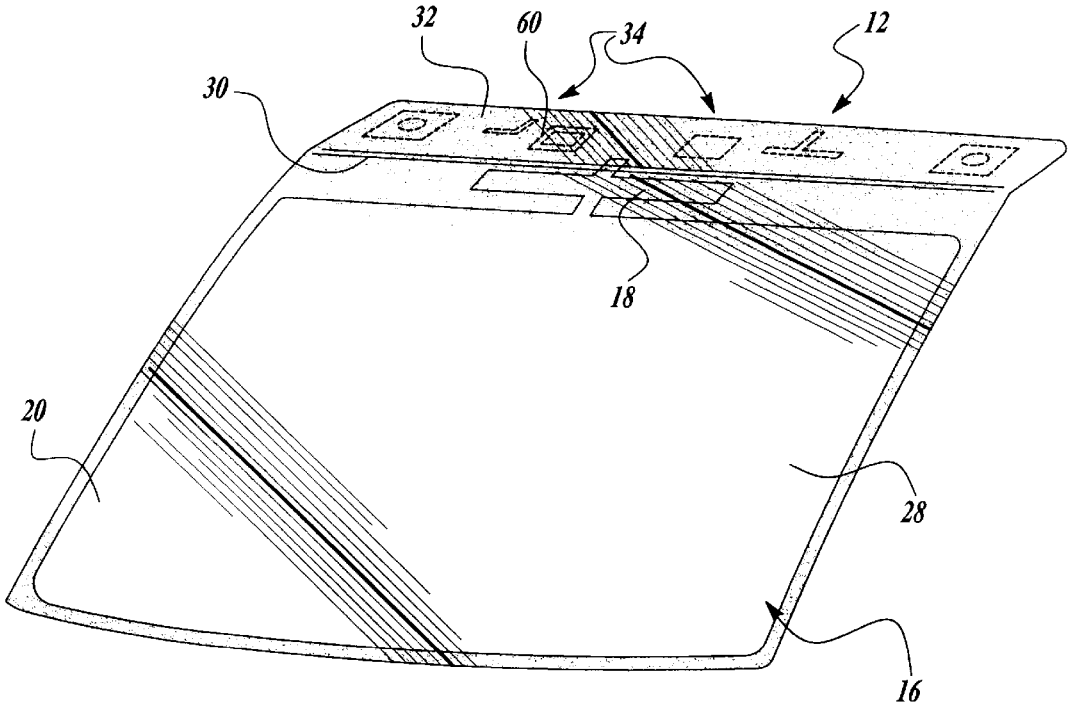
FIG. 2 is a perspective view of the windshield of the vehicle shown in FIG. 1 removed from the vehicle.

FIG. 2 shows the vehicle windshield 12 separated from the vehicle 10, in combination with a plurality of high frequency antennas 34. The windshield 12 includes a front portion 28, a curved portion 30 and a top edge portion 32. The solar-ray antenna 16 is formed in the front portion 28 of the windshield 12. The curved portion 30 extends through the windshield roof line currently existing in the art so that the top portion 32 of the vehicle windshield 12 is actually part of the vehicle roof. As will be discussed in detail below, the antennas 34 are mounted beneath the windshield 12 on an extended portion of the vehicle roof panel 14. The top portion 32 of the windshield 12 acts as an antenna radome for receiving and transmitting antenna energy. The antennas 34 can be any high frequency antenna for use in connection with a vehicle, including RFA, cellular band, GPS, PCS, toll, garage door and radar antennas.

Figure 3:
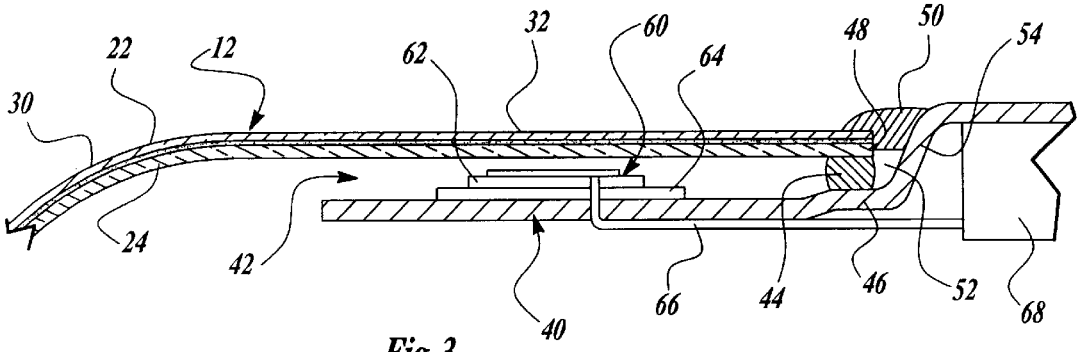
FIG. 3 is a cross-sectional view of a combination windshield and antenna shelf, according to an embodiment of the present invention.

FIG. 3 shows a cross-sectional view through the top portion 34 of the windshield 12 and the roof panel 14. As is apparent, the roof panel 14 includes a shelf 40 extending below the top portion 32 of the windshield 12 and defining a gap 42 therebetween. A seal 44, such as a urethane seal, is provided between a ridge 46 of the shelf 40 just below a top edge 48 of the windshield 12, and seals the windshield 12 to the roof panel 14. A molding 50 is positioned within a gap 52 between the edge 48 of the windshield 12 and a curved part 54 of the roof panel 14 connecting the roof panel 14 to the shelf 40. In one embodiment, the shelf 40 extends four to six inches beneath the top portion 32 of the windshield 12 and is separated therefrom by 0.75 to 1.0 inch. These dimensions are by way of a non-limiting example in that the distance between the top portion 32 and the shelf 40, and the length of the shelf 40 would depend on the kind of antennas being used and the number of antennas provided.

The shelf 40 provides a structure on which the various antennas 34 discussed above can be mounted. In FIG. 3, a patch antenna 60 is mounted on a substrate 62 which is secured to the shelf 40 by an adhesive layer 64. The patch antenna 60 is intended to represent any of the antennas 34 discussed above and has particular application for a GPS antenna. A coaxial cable 66 is connected to the patch antenna 60 and to an antenna electronics box 68 mounted in the vehicle under the roof panel 14, as shown. The electronics box 68 provides a switching source to direct the electrical signals from the antennas 34 to the appropriate receiver/transmitter within the vehicle. In this configuration, the shelf 40 acts as a ground plane for the antennas 34 and prevents antenna radiation from entering the passenger compartment of the vehicle 10. Each of the other antennas 34 would also be mounted on the shelf 40 and include an electrical connection to the electronics box 68.

The embodiments discussed above show the patch antenna 60 mounted to the shelf 40 by the adhesive layer 64. However, in alternate embodiments, the antennas 34 can be mounted within the gap 42 in any suitable configuration, as would be recognized by those skilled in the art. In an alternate embodiment, the antennas 34 can be mounted to an inside surface of the inner glass layer 24 of the windshield 12.

The concept of the shelf 40 can be extended to the rear of the vehicle as a location for mounting high frequency antenna. Vehicle backlite antennas are known in the art that include antenna elements formed of a conductive frit material patterned on an inside surface of the rear window of the vehicle. In different designs, defogger elements are used as the antenna elements, or an antenna grid with antenna elements can be provided separate from the defogger elements. In this design, the rear window of the vehicle would be extended in the manner as discussed above so that it curved over the vehicle roof line and extended some distance along the roof of the vehicle. Likewise, the roof panel 14 would include an extended shelf below the extended portion of the vehicle backlite to provide a location for mounting the high frequency antennas on the shelf below the extended portion of the window. In some designs, both the windshield and vehicle backlite can be extended for high frequency antenna.

By providing the shelf 40 for mounting the various high frequency antennas 34 thereto, a number of advantages can be realized over the antenna designs known in the art. These advantages include mounting locations for additional high frequency antennas; a roof mounting location for providing better reception and transmission allowing for more uniform coverage; a ground plane to isolate the antenna from the various electrical systems of the vehicle; a ground plane to minimize RF transmitted energy from entering the passenger compartment of the vehicle; the ability to allow placement of RF isolation fences between the various antennas; the ability to place small shielded RF electronic components at antenna terminals; and the addition of an RF electronic system shelf in the headliner-roof region directly behind the antenna shelf.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A vehicle structure comprising:

a vehicle window including a first planar portion, a second planar portion and a curved portion therebetween;

a vehicle roof panel positioned adjacent to the second planar portion of the window where the second planar portion and the roof panel are part of a vehicle roof, said roof panel including a shelf portion positioned below the second planar portion and defining a gap therebetween; and a plurality of antennas mounted within the gap between the second planar portion and the shelf portion.

2. The structure according to claim 1 wherein the plurality of antenna are mounted to the shelf portion.

3. The structure according to claim 1 wherein the vehicle window is selected from the group consisting of a vehicle windshield and a vehicle rear window.

4. The structure according to claim 1 wherein the window is a vehicle windshield, said windshield including a solar-ray antenna positioned within the first planar portion of the window.

5. The structure according to claim 1 wherein the plurality of antenna are high frequency antennas selected from the group consisting of cellular antennas, toll antennas, garage door antennas, radar antennas, RFA antennas, and GPS antennas.

6. The structure according to claim 1 further comprising an antenna electronics box positioned in the vehicle beneath the roof panel, each of the plurality of antennas being electrically connected to the antenna electronics box.

7. The structure according to claim 1 wherein the shelf portion extends below the second planar portion a distance within the range of four to six inches.

8. The structure according to claim 1 wherein the gap defined between the second planar portion and the shelf portion has a dimension within the range of 0.75 to 1.0 inch.

9. The structure according to claim 1 wherein the shelf portion is a conductive shelf that provides a ground plane for the antennas and attenuates antenna radiation entering the passenger compartment of the vehicle.

10. An antenna system for a vehicle, said antenna system comprising:

a vehicle windshield including a front portion, a curved portion and a roof portion wherein the curved portion connects the front portion and the roof portion and is positioned proximate a vehicle roof line;

a vehicle roof panel positioned adjacent to the roof portion of the windshield, said roof panel including an antenna shelf positioned below the roof portion of the windshield and defining a gap therebetween;

a plurality of high frequencies antennas mounted to the shelf portion within the gap; and an antenna electronics box positioned in the vehicle beneath the roof panel, each of the plurality of antennas being electrically connected to the antenna electronics box.

11. The structure according to claim 10 wherein the windshield includes a solar-ray antenna positioned within the front portion.

12. The structure according to claim 10 wherein the plurality of antenna are high frequency antennas selected from the group consisting of cellular antennas, toll antennas, garage door antennas, radar antennas, RFA antennas, and GPS antennas.

13. The structure according to claim 10 wherein the antenna shelf extends below the roof portion a distance within the range of four to six inches.

14. The structure according to claim 1 wherein the gap defined between the roof portion and the antenna shelf has a dimension within the range of 0.75 to 1.0 inch.

15. The method of mounting a plurality of high frequency antennas to a vehicle, said method comprising the steps of:

providing a vehicle window that includes a first planar portion, a second planar portion, and a curved portion therebetween;

providing a vehicle roof panel positioned adjacent to the second planar portion of the window where the second planar portion and the roof panel are part of a vehicle roof, said step of providing a roof panel including providing a shelf portion positioned below the second planar portion so as to define a gap therebetween; and mounting the plurality of antennas within the gap between the second planar portion and the shelf portion.

16. The method according to claim 15 wherein the step of mounting the antennas includes mounting the antennas to the shelf portion.

17. The method according to claim 15 wherein the step of providing a vehicle window includes providing a vehicle windshield including a solar-ray antennas positioned therein.

18. The method according to claim 15 further comprising the step of positioning an antenna electronics box within the vehicle beneath the roof panel and electrically connecting each of the antennas to the electronics box.

* * * * *